US005487375A

United States Patent [19]

McDonald, Jr.

[11] Patent Number: 5,487,375

[45] Date of Patent: Jan. 30, 1996

[54] STABILIZERS ADAPTED TO BE CONNECTED TO A BOW

[76] Inventor: Norman J. McDonald, Jr., Rte. 1, Box 155, Hendrix, Okla. 74741

[21] Appl. No.: 239,490

[22] Filed: May 9, 1994

Related U.S. Application Data

[62] Division of Ser. No. 127,846, Sep. 28, 1993.

[51] Int. Cl.[6] ..... F41B 5/20

[52] U.S. Cl. ..... 124/89; 188/380; 267/137

[58] Field of Search ..... 124/23.1, 89; 267/136, 267/137, 175, 177, 122, 170; 42/1.06; 188/317, 322.15, 378, 380

[56] References Cited

U.S. PATENT DOCUMENTS

| | | | |
|---|---|---|---|
| 3,173,514 | 3/1965 | Tiedemann | 188/378 |
| 3,207,009 | 9/1965 | Carlstedt | 188/380 X |
| 3,690,414 | 9/1972 | Aggarwal et al. | 188/378 |
| 3,938,626 | 2/1976 | Hopkins | 188/378 |
| 4,310,149 | 1/1982 | Camilleri | 188/380 X |
| 4,893,606 | 1/1990 | Sisko | 124/89 |
| 4,982,719 | 1/1991 | Haggard et al. | 124/89 |
| 4,986,018 | 1/1991 | McDonald, Jr. | 42/1.06 |
| 5,370,104 | 12/1994 | Neie | 124/89 |

OTHER PUBLICATIONS

Exhibit A—Fine Archery Products Brochure, undated.
Exhibit B—The Greek Custom Archery, Inc. Brochure, undated.
Exhibit C—The Greek Custom Archery, Inc. Brochure, undated.

*Primary Examiner*—John A. Ricci
*Attorney, Agent, or Firm*—Dunlap & Codding

[57] ABSTRACT

A weight collar for use with a stabilizer adapted to be connected to a bow. The weight collar is removably connected to a stabilizer outer peripheral surface of the stabilizer. The weight collar includes a pad constructed of a compressible material whereby the weight collar is movable in upwardly and downwardly directions perpendicular to an axial center line of the weight collar and movable in angular directions relative to the axial center line of the weight-collar while remaining attached to the weight collar. A stabilizer for use with a bow having a stabilizer tube with an opening extending therethrough forming a stabilizer chamber, the stabilizer chamber defining a stabilizer in a peripheral surface. A resonator suppressor ring is disposed in the stabilizer chamber between the first and the second ends of the stabilizer tube. The resonator suppressor ring is expanded in the stabilizer chamber to a position wherein a resonator outer peripheral surface engages the stabilizer inner peripheral surface and the resonator suppressor ring divides the stabilizer chamber into a first chamber and a second chamber, a piston and springs being disposed in the first chamber and another piston and springs being disposed in the second chamber. A piston assembly for use in the stabilizer where the piston assembly comprises a plurality of stacked piston rings.

4 Claims, 6 Drawing Sheets

STABILIZERS ADAPTED TO BE CONNECTED TO A BOW

This is a divisional of application Ser. No. 08/127,846 filed on Sep. 28, 1993.

FIELD OF THE INVENTION

The present invention relates to stabilizers adapted for use with bows and, more particularly, but not by way of limitation, to a weight collar disposed on the outer peripheral surface of a stabilizer which is movable in upwardly and downwardly directions and in angularly directions, and to a resonator suppressor ring which is disposed within a stabilizer chamber of a stabilizer for dividing the stabilizer chamber into a first chamber and a second chamber, and to disrupt the resonating sounds created by the bow that are very undesirable.

BRIEF DESCRIPTION OF THE DRAWINGS

FIG. 6 is a exploded view of the resonator suppressor ring of FIGS. 4 and 5.

DESCRIPTION OF THE PREFERRED EMBODIMENTS

Figure 1:
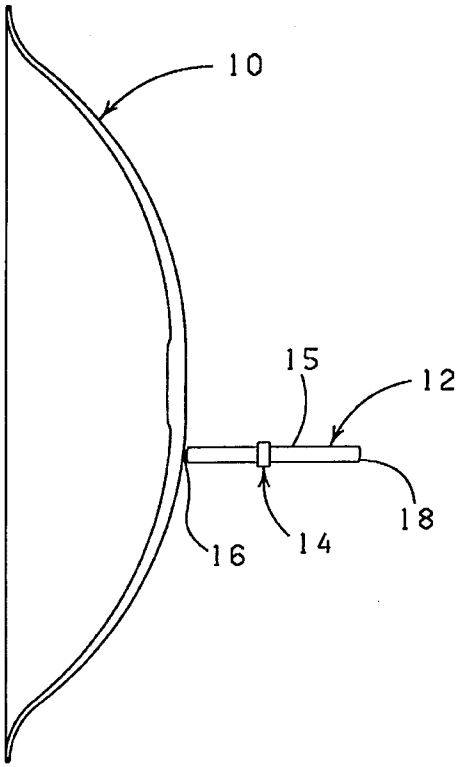
FIG. 1 is a diagrammatic representation of a bow having a stabilizer connected thereto with a weight collar constructed in accordance with the present invention being disposed on the stabilizer.

Shown in FIG. 1 is a diagrammatic representation of a bow 10 adapted to fire an arrow (not shown) in a manner well known in the art and having a stabilizer 12 connected thereto. A weight collar 14 is removably connected to the stabilizer 12.

When an arrow is fired from the bow 10, a recoil action and vibration results which misdirects the arrow and results in undesired noise. The weight collar 14 cooperates with the stabilizer 12 to reduce such vibrations and change the balance point of the bow and add weight to the stabilizer 12.

The stabilizer 12 consists of a hollow tube 15 (FIGS. 1 and 3) having a first end 16 (FIG. 1) and a second end 18 (FIG. 1). The tube 15 has a stabilizer outer peripheral surface 19 (FIG. 3) forming a stabilizer outer diameter 21 (FIG. 3).

Generally, a piston and springs along with a fluid are disposed in the hollow portion of the stabilizer 12, although it should be noted that the weight collar 14 is not limited to use with a stabilizer of this particular construction.

Figure 2:
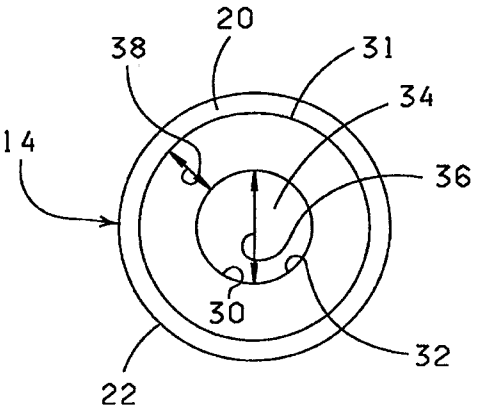
FIG. 2 is an end elevational view of the weight collar of FIG. 1.
Figure 3:
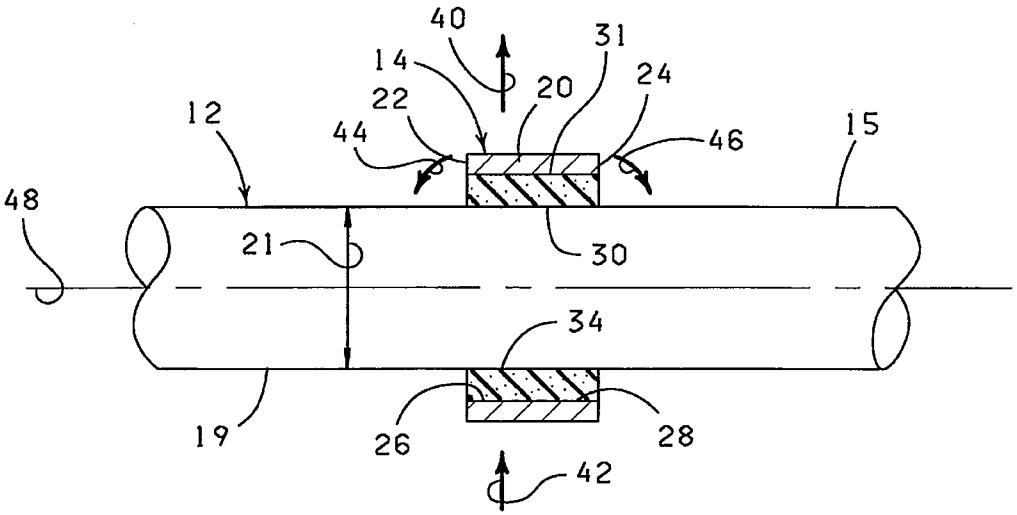
FIG. 3 is a sectional view of the weight collar of FIGS. 1 and 2 with the weight collar being shown disposed on the stabilizer (only a fragmentary portion of the stabilizer being shown in FIG. 3).

As shown more clearly in FIGS. 2 and 3, the weight collar 14 comprises a ring 20 constructed of a relatively rigid, metal material. The ring 20 is generally cylindrically shaped. The ring 20 has a first end 22 (FIGS. 2 and 3) and a second end 24 (FIG. 3). The ring 20 has a ring opening 26 extending through a central portion thereof intersecting the first and the second ends 22 and 24. The ring opening 26 forms a ring inner peripheral surface 28.

As shown in FIGS. 2 and 3, a pad 30 is connected to the ring inner peripheral surface 28 and portions of the pad 30 extend radially outwardly from the ring inner peripheral surface 28 terminating with a pad inner end 32. The pad 30 as shown in FIGS. 2 and 3 is a unitary, solid construction and thus the pad inner end 32 more particularly defines an inner peripheral surface, although the pad 30 could be constructed of segments with each of the segments extending radially inwardly and the inner ends of each of the segments forming the pad inner end 32 if desired in a particular application. The pad inner end 32 defines a pad opening 34 (FIGS. 2 and 3) having a pad diameter 36 (FIGS. 2). The pad diameter 36 is slightly less than the stabilizer outer diameter 21 in an uncompressed condition of the pad 30, as will be described in greater detail below.

The pad 30 is generally cylindrically shaped and has a pad outer peripheral surface 31 (FIGS. 2 and 3).

The pad 30 has a pad thickness 38 extending between the pad outer peripheral surface 31 and the pad inner end 32 (FIG. 2) in an uncompressed condition of the pad 30.

The pad 30 is constructed of a compressible material. Preferably, the pad 30 is constructed of a foam material. One foam-like material which has been found suitable for use as the pad 30 is a foam pad commercially available from Kavco Industries, Inc. of Fort Worth, Tex.

The pad outer peripheral surface 31 is secured to the ring inner peripheral surface 28. In one embodiment, the pad 30 may be adhesively connected to the ring inner peripheral surface 28.

The pad opening 34 is aligned with the stabilizer outer peripheral surface 19 generally at the first end 16 or the second end 18 of the stabilizer 12.

In this position, the weight collar 14 is forcibly moved over the stabilizer 12 with the stabilizer 12 being disposed through the pad opening 34. The weight collar 14 is moved to position the weight collar 14 at a position generally midway between the first and the second ends 16 and 18 of the stabilizer 12 or any place on the stabilizer to change balance or add weight. The weight collar 14 may be located closer to one end of the stabilizer 12 for better balance of the bow if desired. Since the pad diameter 36 in the uncompressed condition is less than the stabilizer outer diameter 21, the stabilizer 12 compresses the pad 30 as the weight collar 14 is moved over the stabilizer outer peripheral surface 19 so that the pad 30 grippingly engages the stabilizer outer peripheral surface 19 to secure the pad 30 in the assembled position and a compressed condition of the pad 30 disposed on the stabilizer outer peripheral surface 19.

The pad thickness 38 is sufficiently large and the material from which the pad 30 is constructed is sufficiently compressible so that the weight collar 30 assembled on the stabilizer 12 is movable in radially outwardly directions 40 (FIG. 3), radially inwardly directions 42 (FIG. 3) and in angularly directions 44 (FIG. 3) and 46 (FIG. 3).

Each of the directions 40, 42, 44 and 46 is with respect to an axial centerline 48 (FIG. 3) of the stabilizer 12 or the weight collar 14 (the axial centerline 48 represents the axial centerline of the stabilizer 12 and the weight collar 14).

The additional weight of the weight collar 14 helps stabilize the bow 10 and reduce vibrations and noise. When the bow 10 is fired, the weight collar 14 is movable in the directions 40, 42, 44 and 46 whereby the pad 30 cooperates to reduce the vibrations thereby reducing the noise resulting from the firing of the bow 10 or, more particularly, resulting from the vibrations caused by the firing of the bow 10.

Figure 4:
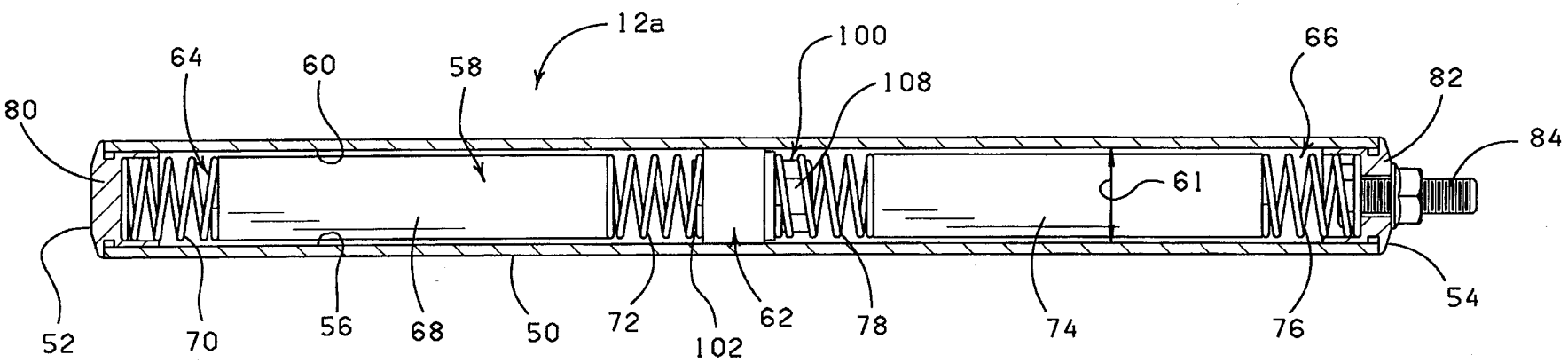
FIG. 4 is a sectional view of a stabilizer having a resonator suppressor ring disposed therein and dividing a stabilizer chamber into a first and a second chamber.

A stabilizer 12*a* is shown in greater detail in FIG. 4. The stabilizer 12 shown in FIGS. 1 and 3 may comprise the stabilizer 12*a*, although the stabilizer 12 shown in FIGS. 1 and 3 is not limited to a stabilizer of any particular construction.

The stabilizer 12*a* comprises a stabilizer tube 50 having a first end 52 and a second end 54. An opening 56 is formed through the stabilizer tube 50. The opening 56 defines a stabilizer chamber 58 and defines a stabilizer inner peripheral surface 60. The stabilizer inner peripheral surface 60 defines a stabilizer inner diameter 61.

A resonator suppressor ring 62 is disposed in the stabilizer chamber 58 and positioned about midway between the first and the second ends 52 and 54 of the stabilizer tube 50. The resonator suppressor ring 62 divides the stabilizer chamber 58 into a first chamber 64 and a second chamber 66.

The resonator suppressor ring 62 reduces resonating sounds which are undesirable when firing a bow.

A first piston 68 is slidingly disposed in the first chamber 64. Two springs 70 and 72 are disposed in the first chamber 64. One end of the spring 70 engages the first end 52 of the stabilizer tube 50 and the opposite end of the spring 70 engages one end of the first piston 68. One end of the spring 72 engages the opposite end of the first piston 68 and the opposite end of the spring 72 engages one end of the resonator suppressor ring 62. A second piston 74 is disposed in the second chamber 66. A pair of springs 76 and 78 also are disposed in the second chamber 66. One end of the spring 76 engages the second end of the stabilizer tube 50 and the opposite end of the spring 76 engages one end of the second piston 74. One end of the spring 78 engages the opposite end of the second piston 74 and the opposite end of the spring 78 engages one end of the resonator suppressor ring 62.

The first and the second pistons 68 and 74 cooperate with the springs 70, 72, 76 and 78 for reducing vibration in a manner well known in the art. Preferably, hydraulic fluid is disposed in the first and the second chambers 64 and 66.

The first end 52 of the stabilizer tube 50 is closed by way of a cap 80. The second end 54 of the stabilizer tube 50 is closed by way of a cap 82.

A threaded member 84 is connected to the cap 82 on the second end 54 of the stabilizer tube 50. The threaded member 84 extends a distance from the first end 52. The threaded member 84 provides a means for threadedly connecting the stabilizer 12*a* to the bow 10 in a manner well known in the art.

Figure 5:
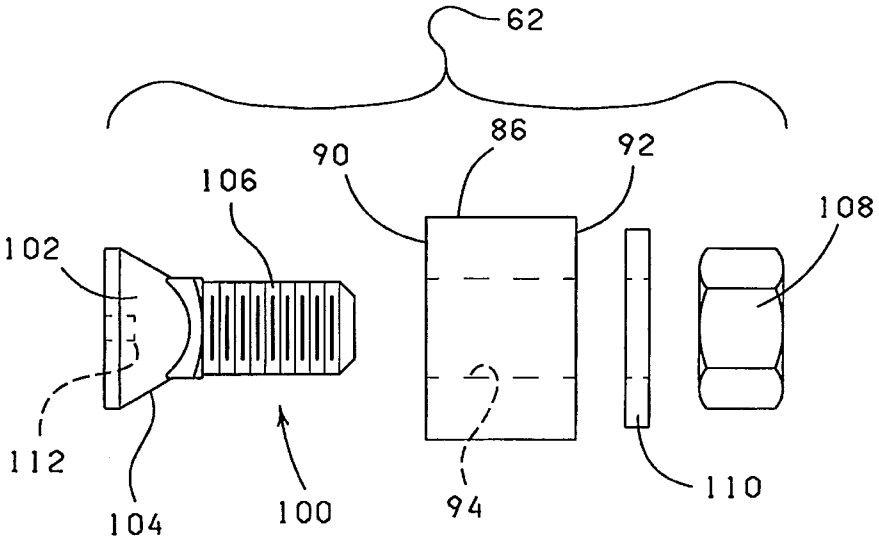
FIG. 5 is a side elevational view of the resonator suppressor ring of FIG. 4.
Figure 5:
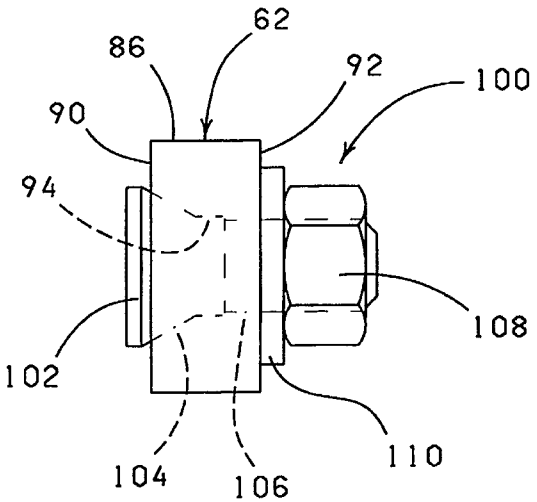
Figure 7:
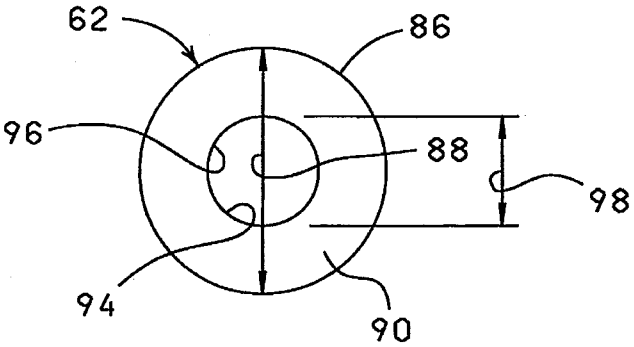
FIG. 7 is an end elevational view of a ring portion of the resonator suppressor ring of FIGS. 4, 5 and 6.

The resonator suppressor ring 62 is shown in more detail in FIGS. 5, 6 and 7. The resonator suppressor ring 62 is generally cylindrically shaped.

The resonator suppressor ring 62 has a suppressor outer peripheral surface 86 defining an outer diameter 88 (FIG. 7) of the resonator suppressor ring 62.

The resonator suppressor ring 62 has a relaxed condition (FIGS. 6 and 7) and an expanded condition (FIGS. 4 and 5). In the relaxed condition, the suppressor outer diameter 88 is slightly less than the stabilizer inner diameter 61. In the expanded condition, the suppressor outer diameter 88 is slightly greater than the stabilizer inner diameter 61.

The resonator suppressor ring 62 is generally cylindrically shaped and has a first end 90 and a second end 92. An expander opening 94 (FIGS. 5 and 6) is formed through the resonator suppressor ring 62. The expander opening 94 intersects the first end 90 and the second end 92. The expander opening 94 forms a expander inner peripheral surface 96 (FIG. 7) defining an expander inner diameter 98 (FIG. 7).

An expander assembly 100 (FIGS. 4, 5 and 6) is movably connected to the resonator suppressor ring 62. The expander assembly 100 is adapted to engage the resonator suppressor ring 62 and move the resonator suppressor ring 62 from the relaxed condition to the expanded condition in one position of the expander assembly 100 and to move the resonator suppressor ring 62 from the expanded condition to the relaxed condition in one other position of the expander assembly 100.

The expander assembly 100 includes a tapered member 102 (FIGS. 4, 5 and 6) having a frusto-conically shaped tapered surface 104 (FIGS. 5 and 6) formed thereon. A threaded member 106 (FIGS. 5 and 6) is connected to the tapered member 102. The threaded member 106 extends a distance from the tapered member 102.

The expander assembly 100 also includes a nut 108 (FIGS. 4, 5 and 6) and a washer 110 (FIGS. 5 and 6). A slot 112 (FIG. 6) is formed in the tapered member 102.

In an assembled position, the tapered member 102 is positioned in the expander opening 94 generally adjacent the first end 90 of the resonator suppressor ring 62 with the tapered member 102 extending through the expander opening 94 and extending a distance outwardly from the second end 92 of the resonator suppressor ring 62. The washer 110 is disposed over the threaded member 106 and disposed generally adjacent the second end 92 of the resonator suppressor ring 62. The nut 108 is threadingly disposed on the threaded member 106 with the nut 108 being disposed generally adjacent the second end 92 of the resonator suppressor ring 62.

In this assembled position, the tapered surface 104 initially engages a portion of the suppressor inner peripheral surface 96 generally adjacent the first end 90 and the suppressor outer diameter 88 is slightly less than the stabilizer inner diameter 61 with the resonator suppressor ring 62 in the relaxed condition. In this relaxed condition, the resonator suppressor ring 62 with the expander assembly 100 connected thereto is insertable through the stabilizer chamber 58 to the position shown in FIG. 4 wherein the resonator suppressor ring 62 is disposed at a position generally midway between the first and the second ends 52 and 54 of the stabilizer tube 50. After the resonator suppressor ring 62 with the expander assembly 100 connected thereto has been disposed in the stabilizer chamber 58 at the predetermined proper position, the operator rotates the nut 108 thereby threadedly moving the threaded member 106 through the nut 108. This movement causes the tapered surface 104 to be moved into the suppressor opening 94 with the tapered surface 104 continually engaging the suppressor inner peripheral surface 96 and forcing the resonator suppressor ring 62 radially outwardly thereby expanding or increasing the suppressor outer diameter 88 and moving the resonator suppressor ring 62 to the expanded position. As the nut 108 is rotated and the resonator suppressor ring 62 is moved to the expanded position, the suppressor outer peripheral surface 86 sealingly and forcibly engages the stabilizer inner peripheral surface to firmly lock or secure the resonator suppressor ring 62 within the stabilizer chamber 58.

If it is desired to move the resonator suppressor ring 62, the nut 108 is rotated in the manner described before (but in opposite direction) thereby loosening the threaded engagement between the threaded member 106 and the nut 108 in removing the tapered member 102 from a substantial portion of the suppressor opening 94, thereby allowing the resonator suppressor ring 62 to be moved from the expanded condition to the relaxed condition wherein the suppressor outer diameter 88 again is less than the stabilizer inner diameter 61. In this relaxed condition, the resonator suppressor ring 62 with the expander assembly 100 connected thereto can be removed from the stabilizer tube 50.

In one preferred embodiment, the resonator suppressor ring 62 is an air conditioner hose of the type used in automotive air conditioning systems. Such members are commercially available from various sources such as Jimmies Automotive of Durant, Okla., Gates-8AC51, Fram SAEJ51 Type AZ 13/22 GLO 4212.

In one preferred embodiment, the resonator suppressor ring 62 has no openings or openings other than the expander opening 94. In this embodiment, as shown in FIGS. 4, 5, 6 and 7, fluid in the first chamber 64 is isolated from fluid in the second chamber 66 and the resonator suppressor ring 62 functions to fluidically isolate the first chamber 64 from the second chamber 66.

In other embodiments, an additional opening may be formed through the resonator suppressor ring 62 to permit fluid to flow between the first chamber 64 and the second chamber 66 if this is desired in some applications.

It should be noted that the suppressor ring 62 can be constructed with no expander assembly where the resonator suppressor ring 62 has an outside diameter larger than the inside diameter of the stabilizer tube. In this instance, the resonator suppressor ring is compressed and forced into the stabilizer tube in the expanded position and removed from the stabilizer tube with the removed resonator suppressor ring being in the relaxed condition.

Figure 8:
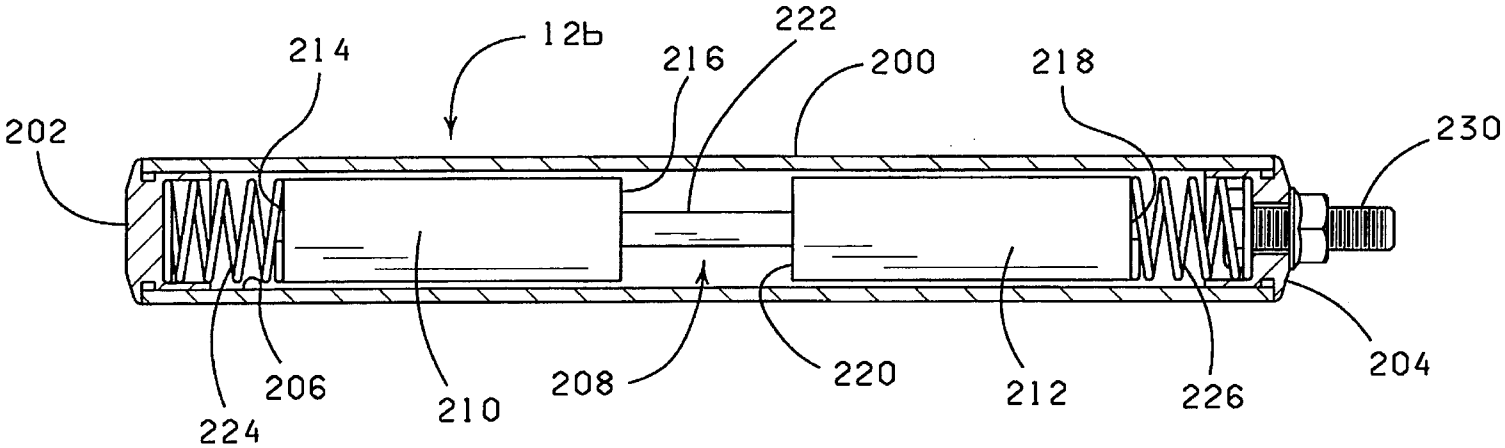
FIG. 8 is a sectional view of a modified stabilizer having two pistons disposed in a stabilizer chamber.

Shown in FIG. 8 is another modified stabilizer **12*b*. Stabilizer 12*b* comprises a stabilizer tube 200 having a first end 202 and a second end 204. An opening 206 is formed through the stabilizer tube 200 and defines a stabilizer chamber 208. The first and the second ends 202 and 204 of the stabilizer 12*b*** are closed by way of caps in the manner described before with respect to the other stabilizers disclosed herein.

A first piston 210 is slidingly disposed in the stabilizer chamber 208. A second piston 212 is slidingly disposed in the stabilizer chamber 208.

The first piston 210 has a first end 214 and a second end 216. The second piston 212 has a first end 218 and a second end 220. The second end 216 of the first piston 210 is connected to the second end 220 of the second piston 212 by way of a connector 222.

A first spring 224 is disposed in the stabilizer chamber 208. A portion of the first spring 224 engages a first end 202 of the stabilizer tube 200 and another portion of the first spring 224 engages the first end 214 of the first piston 210.

A second spring 226 is disposed in the stabilizer chamber 208. A portion of the second spring 226 engages a portion of the second end 204 of the stabilizer tube 200 and another portion of the second spring 226 engages a portion of the first end 218 of the second piston 212.

A threaded member 230 is connected to the second end 204 of the stabilizer tube 200 for connecting the stabilizer **12*b*** to the bow in a manner generally described before.

Hydraulic fluid and/or air is disposed in the stabilizer chamber 208. The inner diameter of the tube is larger than the diameter of the piston so the hydraulic fluid will flow around the piston.

Figure 9:
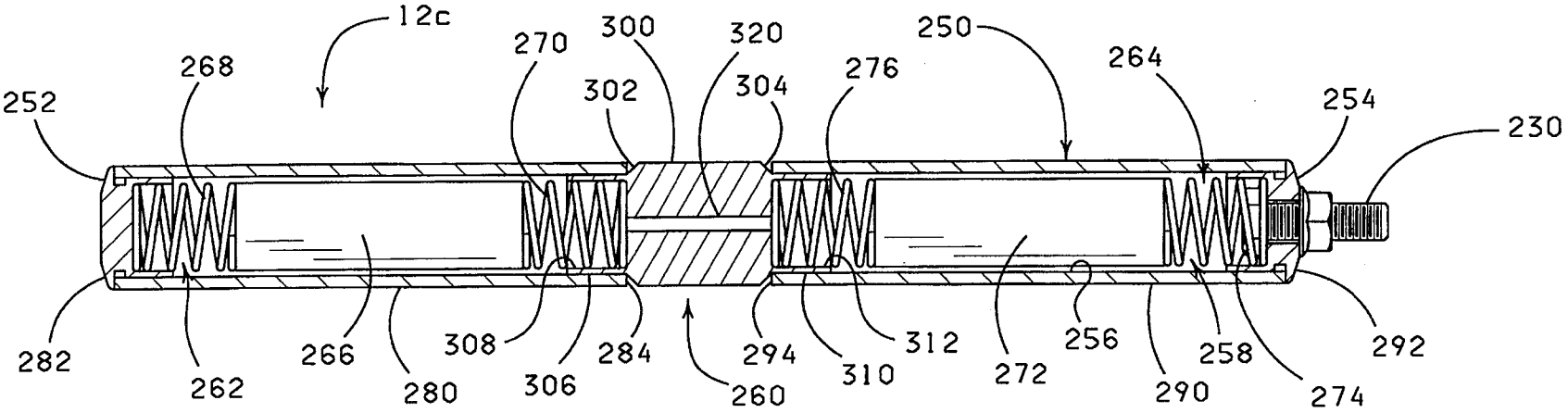
FIG. 9 is a sectional view of another modified stabilizer having a divider ring dividing the stabilizer tube into a first chamber and a second chamber.

It should be noted that, although only two pistons 210 and 212 are shown in FIG. 9, the stabilizer **12*b* may include more than two pistons interconnected in the manner described before with respect to the interconnection of the first piston 210 and the second piston 212**.

Shown in FIG. 9 is another modified stabilizer **12*c*. The stabilizer 12*c* comprises a stabilizer tube 250. The stabilizer tube 250 has a first end 252 and a second end 254. An opening 256 is formed through the stabilizer tube 250 forming a stabilizer chamber 258 within the stabilizer tube 250**.

A divider 260 is interposed in the stabilizer tube 250 generally midway between the first and the second ends 252 and 254 dividing the stabilizer chamber 258 into a first chamber 262 extending generally between the first end 252 of the stabilizer tube 250 and the divider 260 and a second chamber 264 extending generally between the second end 254 of the stabilizer tube 250 and the divider 260.

A first piston 266 is disposed in the first chamber 262. A pair of springs 268 and 270 also are disposed in the first chamber 262. A portion of the spring 268 engages the first end 252 of the stabilizer tube 250 and another portion of the spring 268 engages one end of the first piston 266. One portion of the spring 270 engages one end of the first piston 266 and an opposite portion of the spring 270 engages a portion of the divider 260.

A piston 272 is disposed in the second chamber 264. A pair of springs 274 and 276 are disposed in the second chamber 264. A portion of the spring 274 engages the second end 254 of the stabilizer tube 250 and another portion of the spring 274 engages a portion of the piston 272. A portion of the spring 276 engages a portion of the piston 272 and another portion of the spring 276 engages a portion of the divider 260.

Air and/or hydraulic fluid may be disposed in either one or both of the chambers 262 and 264.

More particularly, the stabilizer tube 250 is divided into a first tube segment 280. The first tube segment 280 has a first end 282 forming the first end 252 of the stabilizer tube 250 and a second end 284. An opening is formed through the first tube segment 280 forming the first chamber 262. The stabilizer tube 250 also comprises a second tube segment 290 having a first end 292 forming the second end 254 of the stabilizer tube 250 and a second end 294. An opening is formed through the second tube segment 290 forming the second chamber 264.

The divider 260 comprises a divider ring 300 having a first end 302 and a second end 304. A first protrusion 306 extends from the first end 302 of the divider ring 300 and a recess 308 is formed in the first protrusion 306.

A second protrusion 310 extends from the second end 304 of the divider ring 300 and a recess 312 is formed in the second protrusion 310.

The second end 284 of the first tube segment 280 is press fitted over the first protrusion 306 and secured to the first end 302 of the divider ring 300. The second end 294 of the second tube segment 290 is press fitted over the second protrusion 310 and secured to the second end 304 of the divider ring 300.

An opening 320 is formed through the divider ring 300 intersecting the first and the second ends 302 and 304. The opening 320 provides fluidic communication between the first chamber 262 and the second chamber 264.

It should be noted that in some embodiments as may be desired in a particular application, the opening 320 may be omitted or deleted so that the divider ring 300 fluidically isolates the first chamber 262 from the second chamber 264.

It should be noted that the divider 260 also acts as a resonator suppressor in a manner like that described before with respect to the resonator suppressor ring 62.

Figure 10:
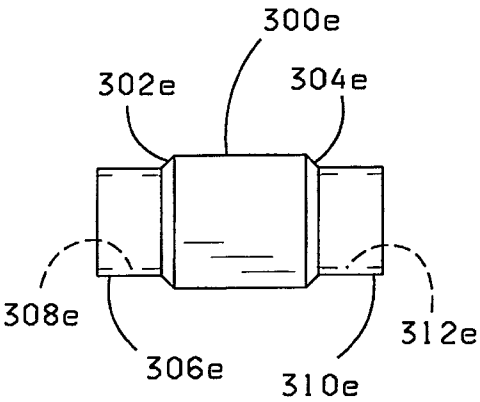
FIG. 10 is a side elevational view of a modified divider ring, similar to the divider ring shown in FIG. 10 for dividing the stabilizer chamber into a first chamber and a second chamber.

Shown in FIG. 10 is a side elevational view of a modified divider ring **300*e* which is constructed exactly like the divider ring 300 shown in FIG. 9, except the divider ring 300*e* does not include an opening extending therethrough like the opening 320 in the divider ring 300 shown in FIG. 9. The divider ring 300*e* is connected to the first tube segment 280 and the second tube segment 290 in a manner exactly like that described before in connection with FIG. 9. The divider ring 300*e* will not provide fluidic communication between the first chamber 262 and the second chamber 264 in the stabilizer tube 12*c*. Rather, the divider ring 300*e* fluidically isolates the first chamber 262 from the second chamber 264 of the stabilizer 12*c***.

Figure 11:
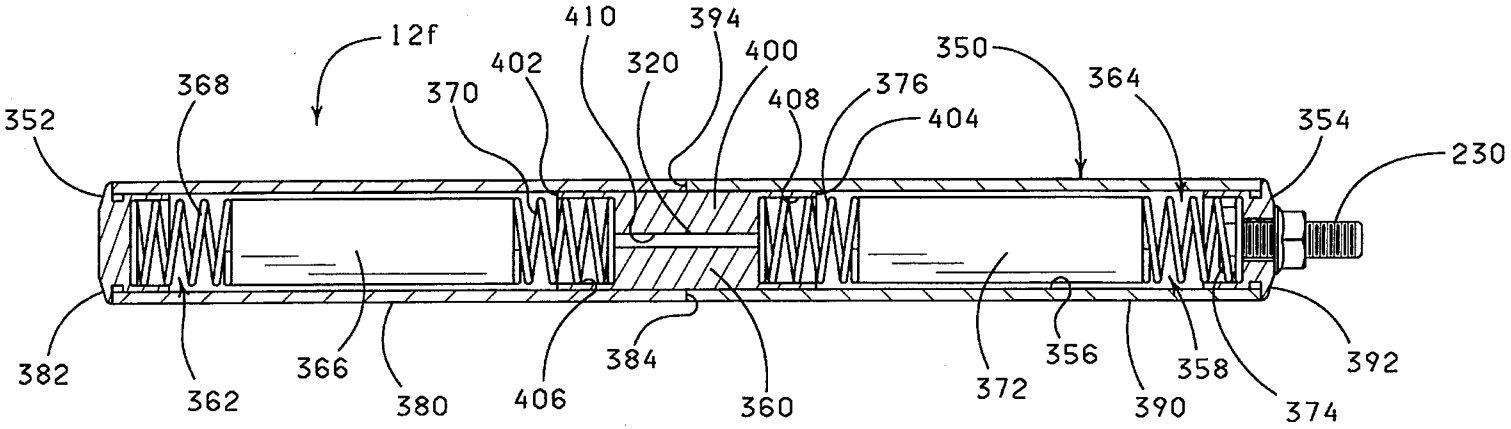
FIG. 11 is a sectional view of yet another modified stabilizer having a divider ring dividing the stabilizer tube into a first chamber and a second chamber.

Shown in FIG. 11 is another modified stabilizer **12*f* which is constructed similar to the stabilizer shown in FIG. 9. The stabilizer 12*f* comprises a stabilizer tube 350. The stabilizer tube 350 has a first end 352 and a second end 354. An opening 356 is formed through the stabilizer tube 350 forming a stabilizer chamber 358 within the stabilizer tube 350**.

A divider 360 is interposed in the stabilizer tube 350 generally midway between the first and the second ends 352 and 354 dividing the stabilizer chamber 358 into a first chamber 362 extending generally between the first end 352 of the stabilizer tube 350 and the divider 360 and a second chamber 364 extending generally between the second end 354 of the stabilizer tube 350 and the divider 360.

A first piston 366 is disposed in the first chamber 362. A pair of springs 368 and 370 also are disposed in the first chamber 362. A portion of the spring 368 engages the first end 352 of the stabilizer tube 350 and another portion of the spring 368 engages one end of the first piston 366. One portion of the spring 370 engages one end of the first piston 366 and an opposite portion of the spring 370 engages a portion of the divider 360.

A piston 372 is disposed in the second chamber 364. A pair of springs 374 and 376 are disposed in the second chamber 364. A portion of the spring 374 engages the second end 354 of the stabilizer tube 350 and another portion of the spring 374 engages a portion of the piston 372. A portion of the spring 376 engages a portion of the piston 372 and another portion of the spring 376 engages a portion of the divider 260.

Air and/or hydraulic fluid may be disposed in either one or both of the chambers 362 and 364.

More particularly, the stabilizer tube 350 is divided into a first tube segment 380. The first tube segment 380 has a first end 382 forming the first end 352 of the stabilizer tube 350 and a second end 384. An opening is formed through the first tube segment 380 forming the first chamber 362. The stabilizer tube 350 also comprises a second tube segment 390 having a first end 392 forming the first end 354 of the stabilizer tube 350 and a second end 394. An opening is formed through the second tube segment 390 forming a second chamber 364.

Figure 12:
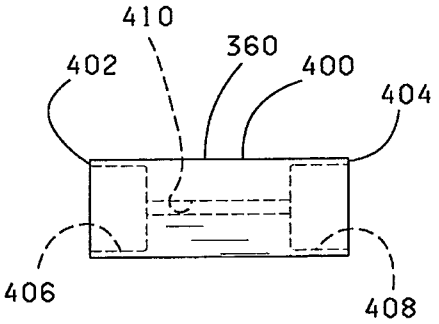
FIG. 12 is a side elevational view of the divider ring used in the stabilizer of FIG. 11.

The divider 360 (shown in FIGS. 11 and 12) comprises a divider ring 400 having a first end 402 and a second end 404. A recess 406 is formed in the first end 402 and a recess 408 is formed in the second end 404 of the divider ring 400.

All opening 410 is formed through the divider ring 400.

The second end 384 of the first tube segment 380 is press fitted over the first end 402 of the divider ring 400. The second end 394 of the second tube segment 390 is press fitted over the second end 404 of the divider ring 300.

It should be noted that in some embodiments as may be desired in a particular application, the opening 410 may be omitted or deleted so that the divider ring 400 fluidically isolates the first chamber 362 from the second chamber 364.

Figure 13:
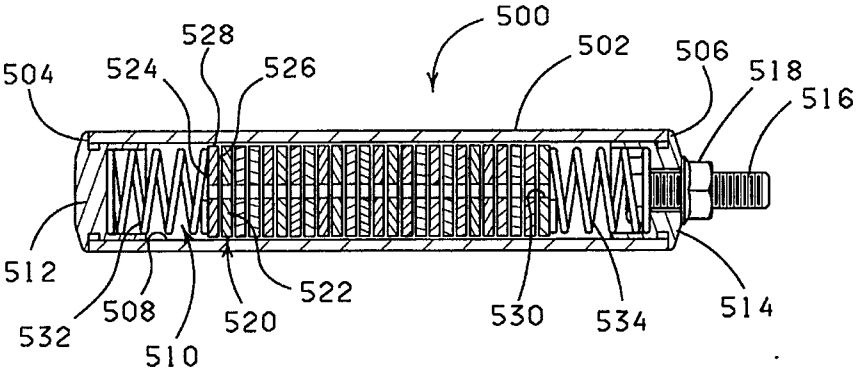
FIG. 13 is a sectional view of a stabilizer having a piston assembly comprising a plurality of piston-rings.
Figure 14:
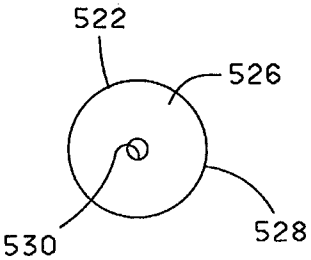
FIG. 14 is a plan view of a typical piston ring.

Shown in FIGS. 13 and 14 is a modified stabilizer 500. Stabilizer 500 comprises a stabilizer tube 502 having a first end 504 and a second end 506. An opening 508 is formed through the stabilizer tube 500 and defines a stabilizer chamber 510. The first and the second ends 504 and 506 of the stabilizer 500 are closed by way of caps 512 and 514, respectively, and a threaded member 516 and nut 518 are connected to the cap 514 for connecting the stabilizer 500 to the bow in the manner described before with respect to the other stabilizers disclosed herein.

A piston assembly 520 is slidingly disposed in the stabilizer chamber 510. The piston assembly 520 comprises at least two piston rings 522. Twenty five piston rings 522 are shown in FIG. 13, and shown in FIG. 14 is a plan view of a typical piston ring 522.

Each piston ring 522 is circularly shaped. Each piston ring 522 has a first surface 524 and a second surface 526. Each piston ring 522 has an outer peripheral edge 528.

The piston rings 522 are stacked with each piston ring 522 being disposed adjacent at least one of the other piston rings 522. The piston rings 522 are identical in construction. The diameter of each piston ring 522 is slightly less than the inner diameter of the stabilizer tube 500 so the piston rings 522 are slidingly disposed in the stabilizer chamber 510. In one preferred embodiment, there was a 0.006 inch clearance between the outer peripheral edges 528 of the piston rings 522 and the stabilizer tube 500, for example.

An opening 530 is formed through a central portion of each of the piston rings 522. When the piston rings 522 are stacked together to form the piston assembly 520, the openings 530 are generally aligned. The openings 530 provide a path for permitting fluid to flow through the piston assembly 520. In some applications, the openings 530 may be eliminated. If the openings 530 are eliminated, the fluid (oil) will flow around the piston assembly 520.

The stack of piston rings 522 creates a flexible, softer piston action. The piston assembly 520 resists movement and absorbs energy.

A first spring 532 is disposed in the stabilizer chamber 510. A portion of the first spring 532 engages a first end 504 of the stabilizer tube 502 or, more particularly, the cap 512, and another portion of the first spring 532 engages the piston assembly 520.

A second spring 534 is disposed in the stabilizer chamber 510. A portion of the second spring 534 engages a portion of the stabilizer tube 502, or, more particularly, the cap 514, and another portion of the second spring 534 engages a portion of the second piston 534.

Figure 15:
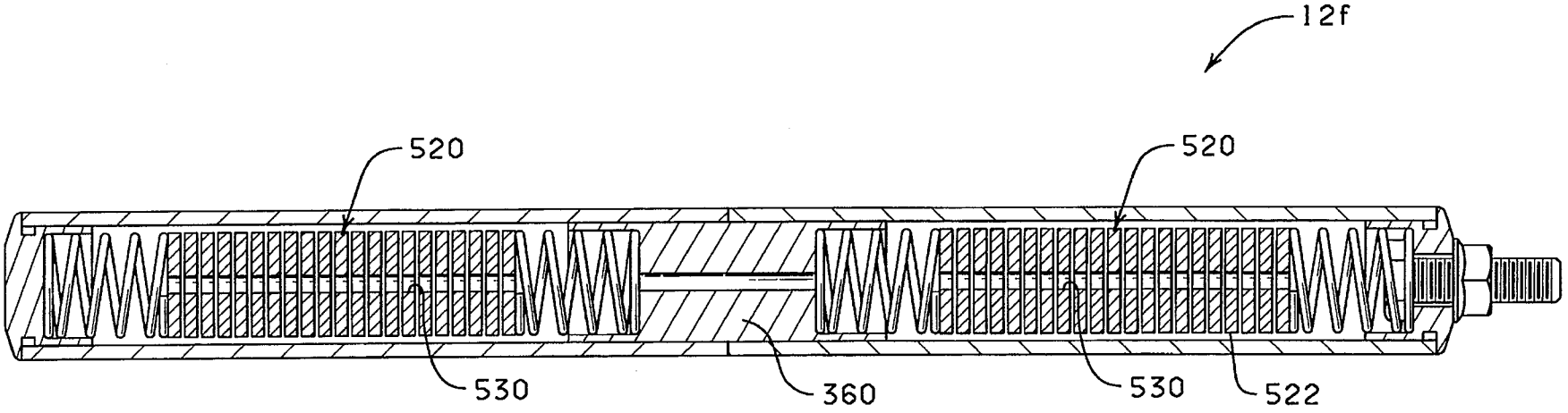
FIG. 15 is a sectional view of a stabilizer having a pair of piston assemblies each comprising a plurality of piston rings.

As illustrated in FIG. 15, a pair of piston assemblies 500 can be utilized in the stabilizer 12*f*. It will be appreciated that the piston assembly 500 can be utilized in the stabilizers 12*a*, 12*b*, or 12*c*.

Changes may be made in the construction and the operation of the various components, elements and assemblies described herein and changes may be made in the steps or the sequence of steps of the methods described herein without departing from the spirit and scope of the invention as defined in the following claims.

What is claimed is:

1. A stabilizer for use with a bow comprising:

a stabilizer tube having a first end and a second end, a stabilizer opening being formed through the stabilizer tube forming a stabilizer chamber, the stabilizer tube comprising:

a first tube segment having a first end forming the first end of the stabilizer tube and a second end, a first chamber being formed in the first tube segment forming a portion of the stabilizer chamber; and a second tube segment having a first end forming the second end of the stabilizer tube and a second end, a second chamber being formed in the second tube segment forming a portion of the stabilizer chamber;

a divider ring, the second end of the first tube segment being connected to the divider ring and the second end of the second tube segment being connected to the divider ring, the divider ring having an opening formed therethrough providing fluidic communication between the first chamber and the second chamber;

a first piston disposed in the first chamber;

spring means disposed in the first chamber for resiliently positioning the first piston between the first end of the first tube segment and the divider ring;

a second piston disposed in the second chamber; and spring means disposed in the second chamber for resiliently positioning the second piston between the second end of the second tube segment and the divider ring.

2. A stabilizer for a bow, comprising:

a stabilizer tube having a first end, a second end, and an opening formed through the stabilizer tube forming a stabilizer chamber;

means for dividing the stabilizer chamber into a first chamber and a second chamber;

a first piston assembly slidingly disposed in the first chamber, the piston assembly comprising at least two piston rings each having a first surface, a second surface, and an outer peripheral surface, the piston rings being disposed adjacent one another and dimensioned so that the diameter of each piston ring is less than the diameter of the first chamber such that each piston ring is free to move transversely across the first chamber separately and independently of the other piston rings;

first spring means disposed in the first chamber for resiliently positioning the first piston assembly between the first end of the stabilizer tube and the means for dividing;

a second piston assembly slidingly disposed in the second chamber, the second piston assembly comprising at least two piston rings each having a first surface, a second surface, and an outer peripheral surface, the piston rings being disposed adjacent one another and dimensioned so that the diameter of each piston ring is less than the diameter of the second chamber such that each piston is free to move transversely across the second chamber separately and independently of the other piston rings;

second spring means disposed in the second chamber for resiliently positioning the second piston assembly between the second end of the stabilizer tube and the means for dividing; and fluid means disposed in the first chamber and the second chamber for damping recoil and vibration from the bow in conjunction with the first and second piston assemblies and the first and second spring means.

3. The stabilizer of claim 2 wherein the piston rings of the first piston assembly and the second piston assembly are each provided with an opening formed through a central portion thereof to provide fluidic communication through the first and second piston assemblies.

4. The stabilizer of claim 2 wherein the means for dividing has an opening formed therethrough providing fluidic communication between the first chamber and the second chamber.

* * * * *

UNITED STATES PATENT AND TRADEMARK OFFICE

CERTIFICATE OF CORRECTION

PATENT NO. : 5,487,375

DATED : January 30, 1996

INVENTOR(S) : Norman J. McDonald, Jr.

It is certified that error appears in the above-identified patent and that said Letters Patent is hereby corrected as shown below:

Title page, under Section [57] ABSTRACT, line 8, please delete "weight-", and substitute therefor --weight--.

Column 4, line 24, please delete "a", and substitute therefor --an--.

Column 8, line 13, please delete "first", and substitute therefor --second--.

Column 9, line 10, please delete "second".

Column 9, line 10, please delete "534", and substitute therefor --assembly 520--.

Column 9, line 11, please delete "500", and substitute therefor --520--.

Column 10, line 14, please delete "transversely", and substitute therefor --traversely--.

UNITED STATES PATENT AND TRADEMARK OFFICE

CERTIFICATE OF CORRECTION

PATENT NO. : 5,487,375

DATED : January 30, 1996

INVENTOR(S) : Norman J. McDonald, Jr.

It is certified that error appears in the above-indentified patent and that said Letters Patent is hereby corrected as shown below:

Column 10, line 28, please delete "transversely", and substitute therefor --traversely--.

Signed and Sealed this

Second Day of July, 1996

Bruce Lehman

*Attest:*

BRUCE LEHMAN

*Attesting Officer*

*Commissioner of Patents and Trademarks*